US009153906B1

(12) United States Patent
Wu et al.

(10) Patent No.: US 9,153,906 B1
(45) Date of Patent: Oct. 6, 2015

(54) SOCKET CONNECTOR

(71) Applicant: Cheng Uei Precision Industry Co., Ltd., New Taipei (TW)

(72) Inventors: Yun Wu, Dong-Guan (CN); Chao Yong Ye, Dong-Guan (CN); Kai Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/329,983

(22) Filed: Jul. 13, 2014

(51) Int. Cl.
*H01R 13/432* (2006.01)
*H01R 13/627* (2006.01)
*H01R 24/64* (2011.01)

(52) U.S. Cl.
CPC ..... *H01R 13/6275* (2013.01); *H01R 24/64* (2013.01)

(58) Field of Classification Search
CPC ..... H01R 13/6275
See application file for complete search history.

(56) References Cited

U.S. PATENT DOCUMENTS

| | | | | |
|---|---|---|---|---|
| 5,021,002 | A * | 6/1991 | Noschese | 439/352 |
| 6,159,031 | A * | 12/2000 | Llapitan et al. | 439/326 |
| 7,182,622 | B2 * | 2/2007 | Chang | 439/352 |
| 7,981,539 | B2 * | 7/2011 | Lai | 429/159 |
| 8,282,400 | B2 * | 10/2012 | Yang et al. | 439/55 |
| 8,641,455 | B2 * | 2/2014 | Lan | 439/660 |
| 8,956,171 | B2 * | 2/2015 | Wang | 439/260 |
| 2013/0210261 | A1 * | 8/2013 | Weber et al. | 439/358 |
| 2014/0057479 | A1 * | 2/2014 | Weber et al. | 439/357 |
| 2014/0073170 | A1 * | 3/2014 | Golko et al. | 439/350 |
| 2014/0141651 | A1 * | 5/2014 | Lan | 439/626 |

* cited by examiner

*Primary Examiner* — James Harvey
(74) *Attorney, Agent, or Firm* — Cheng-Ju Chiang

(57) ABSTRACT

A socket connector includes an insulating housing defining an inserting chamber in the front thereof and a receiving groove in the back face thereof, a plurality of conductive terminals disposed in the insulating housing, and a latch. Two sides of the receiving groove further extend forward to form two inserting grooves of which each front end is communicated with the inserting chamber. The latch has a first base plate positioned in the receiving groove. Two opposite side edges of the first base plate are bent and extend forward to form two first clamping portions inserted in the inserting grooves with front ends thereof projecting into the inserting chamber. Two opposite outer sides of the first clamping portions protrude outward to form a pair of bumps located in the rear of the first clamping portions and resisting against outmost two inner sidewalls of the inserting grooves.

7 Claims, 5 Drawing Sheets

SOCKET CONNECTOR

BACKGROUND OF THE INVENTION

1. Field of the Invention

The present invention relates to a connector, and more particularly to a socket connector.

2. The Related Art

Currently, with the development of modern information technology, various connectors have been widely used in electronic products for connecting with a matching plug connector to realize signal transmission. A conventional socket connector includes an insulating housing, a plurality of conductive terminals disposed in the insulating housing, and a shielding shell enclosing the insulating housing and the conductive terminals. The socket connector is mounted in an electronic product. In use, the matching plug connector is inserted into the socket connector to realize the signal transmission between the plug connector and the electronic product.

However, in the process of inserting and extracting the plug connector with respect to the socket connector, the action point between the plug connector and the socket connector is likely to be unstable owing to the unstable force resulted from improper insertion and extraction. Accordingly, some structures connecting the socket connector with the electronic product are easy to loose, and the signal transmission is unexpectedly disconnected.

SUMMARY OF THE INVENTION

Accordingly, an object of the present invention is to provide a socket connector. The socket connector includes an insulating housing, a plurality of conductive terminals and a latch. The insulating housing has a base portion and an inserting portion protruding forward from a front face of the base portion. A front face of the inserting portion is concaved and extends rearward to the base portion to form an inserting chamber. The back face of the base portion defines a receiving groove transversely extending. Two sides of a front inner wall of the receiving groove are further concaved forward to form two inserting grooves of which each front end is located at the opposite side of the inserting chamber and communicated with the inserting chamber. The conductive terminals are disposed in the insulating housing. Each of the conductive terminals has a contact portion at a front end thereof which projects into the inserting chamber. The latch has a first base plate positioned vertically in the receiving groove of the insulating housing. Two opposite side edges of the first base plate are bent and extend forward to form two first clamping portions slanted towards each other and inserted forward in the inserting grooves of the insulating housing. The free end of each first clamping portion is arched inward to form a buckling portion elastically projecting into the inserting chamber. Two opposite outer sides of the first clamping portions protrude outward to form a pair of bumps located in the rear of the first clamping portions. The rears of the first clamping portions are close to outmost two inner sidewalls of the inserting grooves of the insulating housing with the bumps resisting against the outmost two inner sidewalls of the inserting grooves.

As described above, in the process of inserting and extracting a plug connector with respect to the socket connector, the bumps of the first clamping portions of the latch always keep resisting against the outmost two inner sidewalls of the inserting grooves of the insulating housing. So that can make the action point between the latch and the insulating housing stable, and further ensure a steady insertion and extraction force between the plug connector and the socket connector. Moreover, the insertion and extraction force can be adjusted by changing the height or the position of the bumps.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
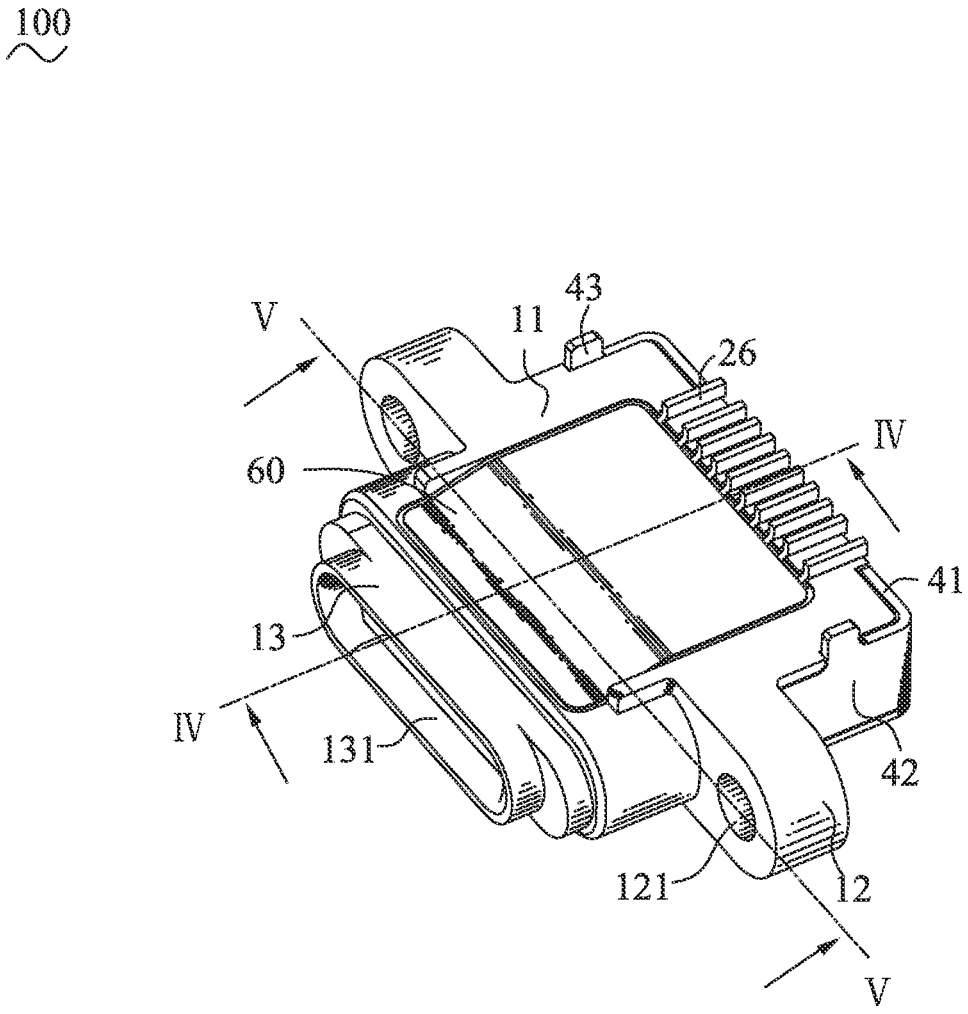
FIG. 1 is an assembled perspective view of a socket connector according to an embodiment of the present invention.
Figure 2:
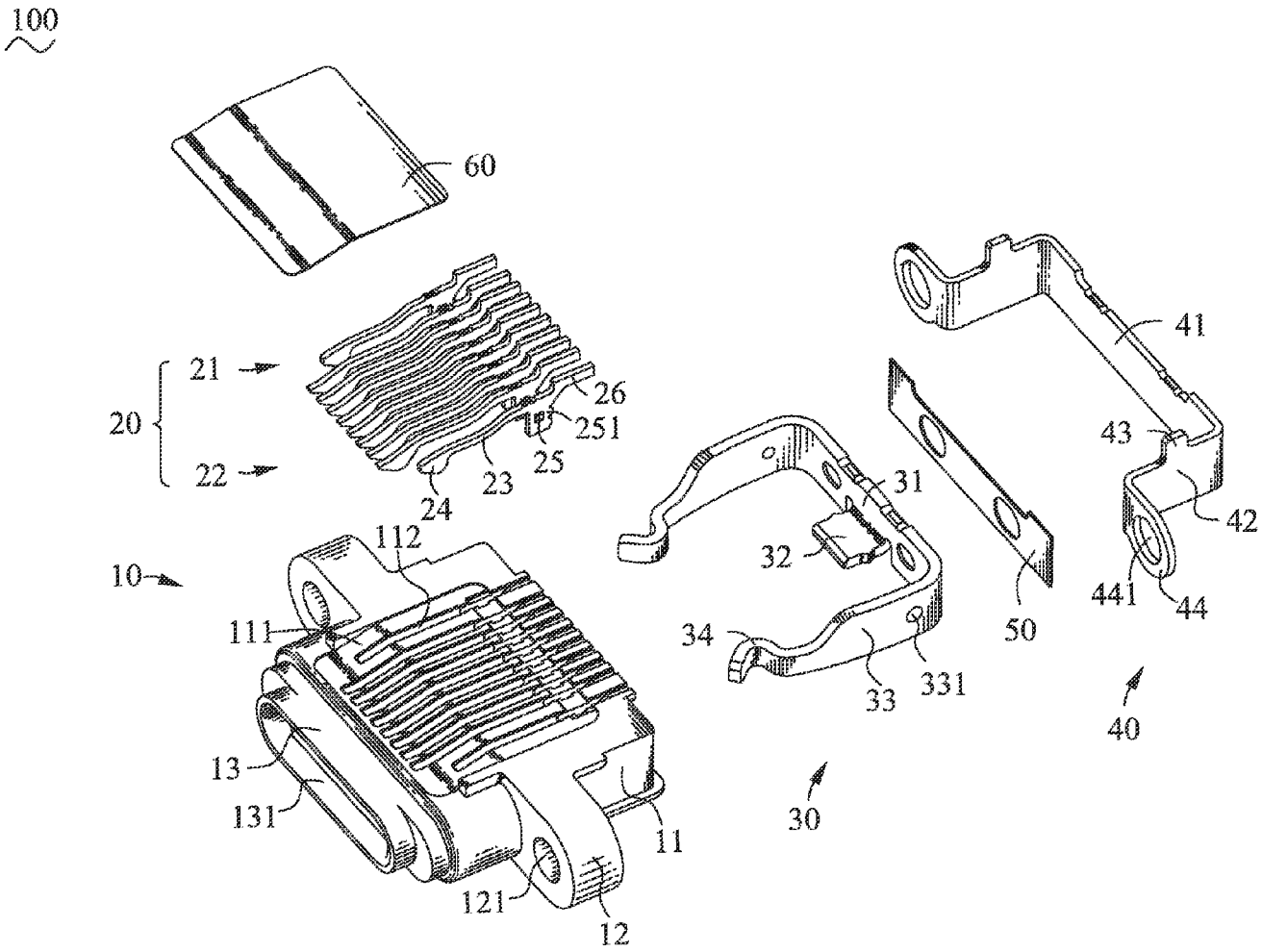
FIG. 2 is an exploded perspective view of the socket connector of FIG. 1.

Referring to FIG. 1 and FIG. 2, a socket connector 100 in accordance with an embodiment of the present invention is adapted to being assembled on a circuit board (not shown). The socket connector 100 includes an insulating housing 10, a plurality of conductive terminals 20 and a latch 30.

Figure 3:
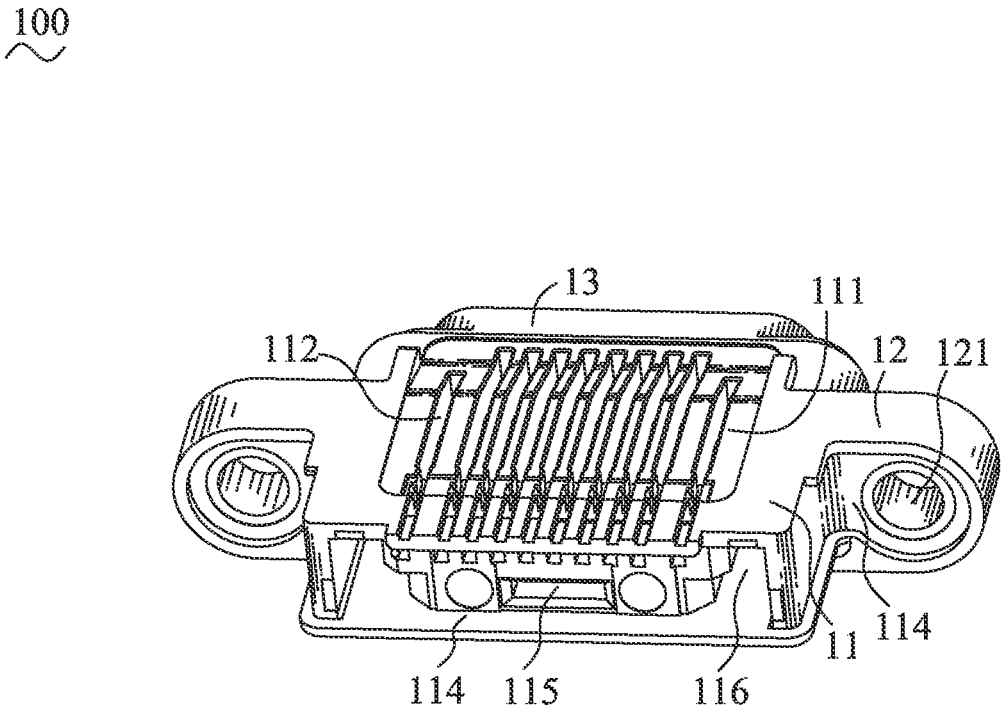
FIG. 3 is a perspective view of an insulating housing of the socket connector of FIG. 1.
Figure 4:
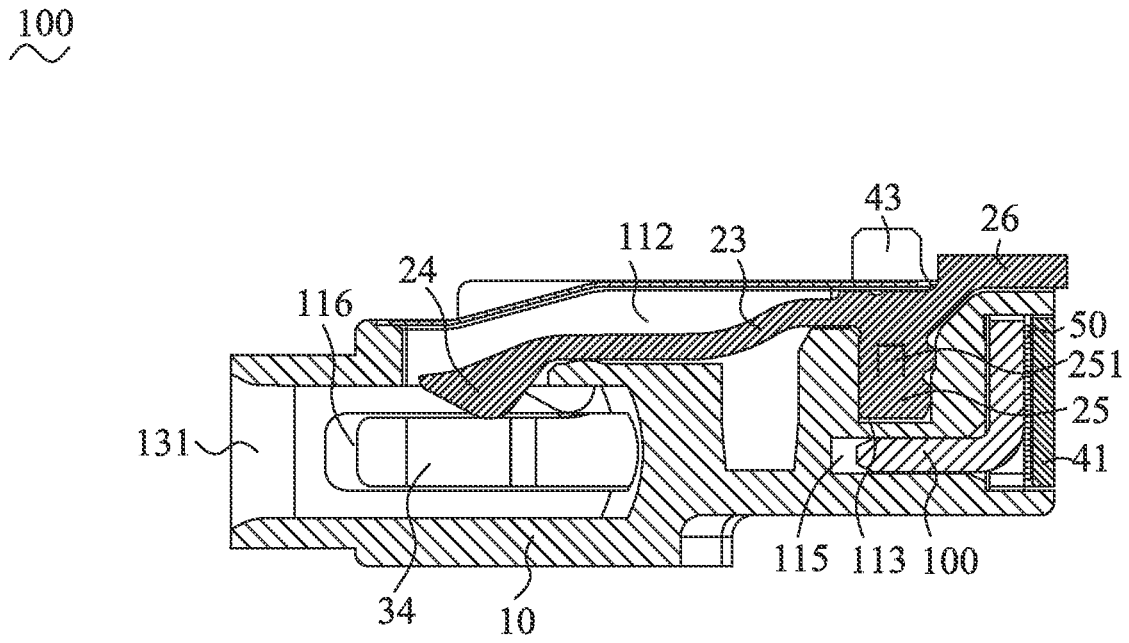
FIG. 4 is a cross-sectional view of the socket connector along the line IV of FIG. 1.
Figure 5:
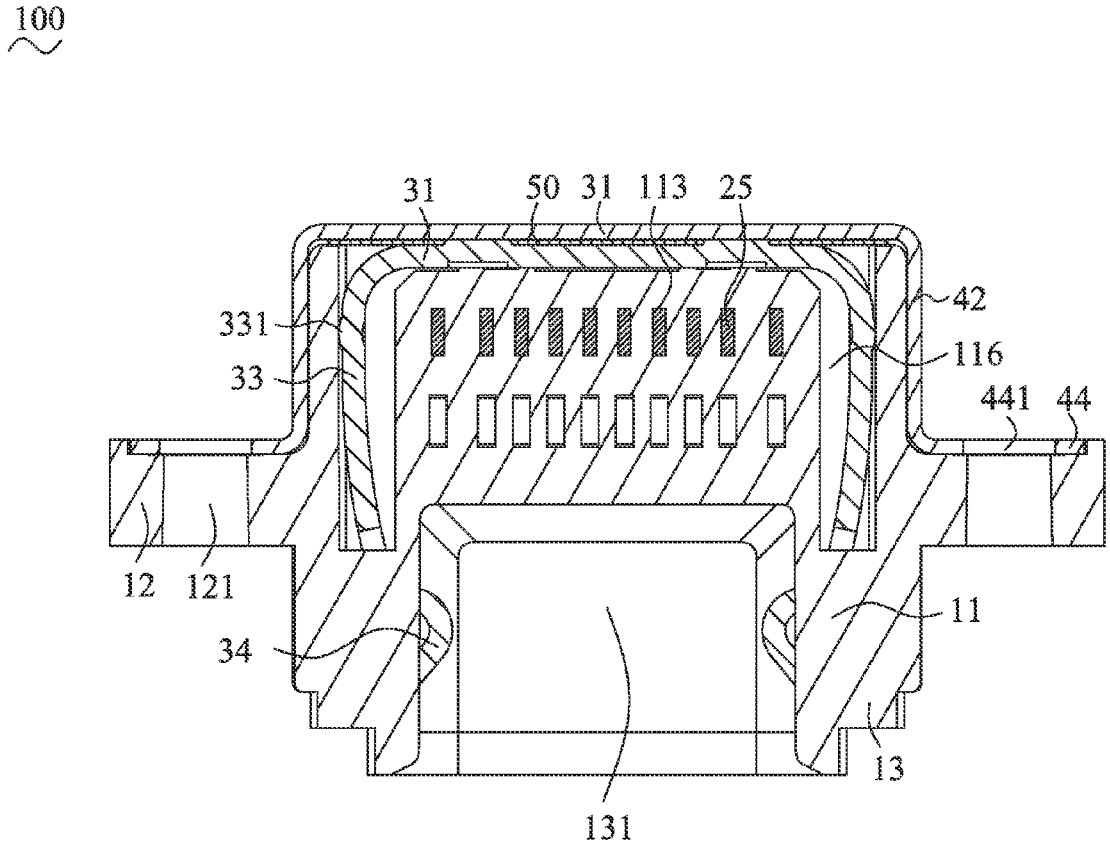
FIG. 5 is a cross-sectional view of the socket connector along the line V of FIG. 1.

Referring to FIG. 2, FIG. 3 and FIG. 4, the insulating housing 10 has a base portion 11. A substantial middle of each side surface of the base portion 11 protrudes outward to form a wing 12. Each wing 12 defines a first locking hole 121 which penetrates longitudinally through the wing 12. An inserting portion 13 protrudes forward from a front face of the base portion 11. A front face of the inserting portion 13 is concaved and extends rearward to the base portion 11 to form an inserting chamber 131.

A top surface of the base portion 11 is concaved downward to form a notch 111. A bottom wall of the notch 111 defines a plurality of terminal grooves 112 which extend along a front-to-rear direction and penetrate backward through the base portion 11. A rear end of each terminal groove 112 further extends downward to form a fastening groove 113. The inserting chamber 131 is communicated with a front end of each terminal groove 112. The back face of the base portion 11 defines a receiving groove 114 extending transversely and then extending longitudinally to the side surfaces of the base portion 11 and further sideward to the back surfaces of the wings 12. The receiving groove 114 is communicated with the first locking hole 121. A front inner wall of the receiving groove 114 in the rear of the base portion 11 is further concaved forward to form a fastening slot 115 arranged in the bottom of the front inner wall of the receiving groove 114. Two sides of the front inner wall of the receiving groove 114 in the rear of the base portion 11 are further concaved forward to form two inserting grooves 116 of which each front end is located at the opposite side of the inserting chamber 131 and communicated with the inserting chamber 131.

Referring to FIG. 2 and FIG. 4, the conductive terminals 20 are disposed in the terminal grooves 112 of the insulating housing 10. The conductive terminals 20 include two detection terminals 21 and a plurality of signal terminals 22. Each of the conductive terminals 20 has a fastening arm 23 and a contact portion 24 at a front end thereof which protrudes downward from a front end of the fastening arm 23. A rear end of the fastening arm 23 protrudes downward to form a holding arm 25 on which fixing portions 251 are protruded. The rear edge of each fastening arm 23 is slanted upward and extends rearward to form a first soldering arm 26. The fastening arms 23 are fastened in the terminal grooves 112. Each contact portion 24 projects downward into the inserting chamber 131 of the insulating housing 10. The holding arms 25 are inserted and fastened in the fastening grooves 113 of the terminal grooves 112 with the fixing portions 251 interfering with inner sidewalls of the fastening grooves 113. The first soldering arms 26 project upward beyond the top surface of the base portion 11 for being soldered with the circuit board.

Referring to FIG. 2, FIG. 3, FIG. 4 and FIG. 5, the latch 30 is accommodated in the receiving groove 114 of the insulating housing 10 and inserted in the inserting grooves 116 of the insulating housing 10. The latch 30 has a first base plate 31 positioned vertically in the receiving groove 114 of the insulating housing 10 in the rear of the base portion 11. A substantial middle of a bottom edge of the first base plate 31 is bent forward and extends to form a fastening portion 32. Two opposite side edges of the first base plate 31 are bent and extend forward to form two first clamping portions 33 slanted towards each other. The free end of each first clamping portion 33 is arched inward to form a buckling portion 34. The fastening portion 32 is inserted and fastened in the fastening slot 115. The first clamping portions 33 are inserted forward in the inserting grooves 116 of the insulating housing 10. The buckling portions 34 elastically project into the inserting chamber 131. The back face of the first base plate 31 protrudes rearward to form a plurality of connecting bumps (not labeled). Two opposite outer sides of the first clamping portions 33 protrude outward to form a pair of bumps 331 located in the rear of the first clamping portions 33 and always resisting against outmost two inner sidewalls of the inserting grooves 113 of the insulating housing 10.

Referring to FIG. 1, FIG. 2 and FIG. 3, the socket connector 100 further includes a bracket 40 which is accommodated in the receiving groove 114 of the insulating housing 10 and located behind the latch 30. The bracket 40 has a second base plate 41 covering the first base plate 31 of the latch 30. Two opposite side edges of the second base plate 41 are bent forward and extend to form two second clamping portions 42. Each second clamping portion 42 protrudes upward to form a second soldering arm 43. Front ends of the second clamping portions 42 are oppositely bent outward and extend to form a pair of locking portions 44. The second clamping portions 42 are disposed in the receiving grooves 114 of the side surfaces of the base portion 11. The second soldering arms 43 project upward beyond the top surface of the base portion 11 for being soldered with the circuit board. The locking portions 44 are disposed in the receiving grooves 114 of the wings 12. Each locking portion 44 defines a second locking hole 441 which is aligned with the first locking hole 121 of the wing 12 for securing the bracket 40 and the insulating housing 10 together by means of an external securing member (not shown), so as to further reinforce the latch 30 in the insulating housing 10.

Referring to FIG. 1 and FIG. 2, the socket connector 100 further includes a film 50 and an insulating film 60. The back face of the first base plate 31 of the latch 30 is covered with the film 50. The connecting bumps of the latch 30 are exposed through the film 50 to be spot welded with the second base plate 41 of the bracket 40, wherein the connecting bumps of the latch 30 are surrounded by the film 50 to prevent the welding material from moving in all directions to short-circuit with the conductive terminals 20. The insulating film 60 is disposed in the notch 111 and covers the fastening arms 23 of the conductive terminals 20 to avoid the conductive terminals 20 short-circuiting in the terminal grooves 112.

Referring to FIG. 1, FIG. 2, FIG. 3, FIG. 4 and FIG. 5, when the socket connector 100 is in assembly, the conductive terminals 20 are disposed in the terminal grooves 112 of the insulating housing 10 with the detection terminals 21 being fastened in the outmost two terminal grooves 112. In detail, the fastening arms 23 are fastened in the terminal grooves 112. Each contact portion 24 of the conductive terminals 20 projects into the inserting chamber 131 of the insulating housing 10. The holding arms 25 are inserted and fastened in the fastening grooves 113 of the terminal grooves 112. The first soldering arms 26 are welded with the circuit board. The latch 30 is accommodated in the receiving groove 114 of the insulating housing 10 and inserted in the inserting grooves 116 of the insulating housing 10. The fastening portion 32 is inserted and fastened in the fastening slot 115. The first clamping portions 33 are inserted forward in the inserting grooves 116 of the insulating housing 10. The rears of the first clamping portions 33 are close to the outmost two inner sidewalls of the inserting grooves 116 of the insulating housing 10 with keeping the bumps 331 resisting against the outmost two inner sidewalls of the inserting grooves 116. The buckling portions 34 elastically project into the inserting chamber 131 of the insulating housing 10. The bracket 40 is accommodated in the receiving groove 114 of the insulating housing 10 and located behind the latch 30. The second soldering arms 43 of the bracket 40 are welded with the circuit board. The locking portions 44 of the bracket 40 are disposed in the receiving groove 114 of the wings 12. The first locking holes 121 of the wings 12 are aligned with the second locking holes 441 of the locking portions 44. The wings 12 and the locking portions 44 are fastened together by the external securing member. The second base plate 41 of the bracket 40 and the first base plate 31 of the latch 30 are connected by spot welding on the connecting bumps. The film 50 is covered on the back face of the first base plate 31 of the latch 30. The film 50 is used to avoid the conductive terminals 20 contacting with the residues produced by the spot welding, and further avoid the conductive terminals 20 and combination of the latch 30 and the bracket 40 short-circuiting.

In use, when insert a plug connector (not shown) into the inserting chamber 131 of the socket connector 100, electrical connection is realized between the conductive terminals 20 and the plug connector. The buckling portions 34 of the latch 30 are pressed outward by the plug connector to make the first clamping portions 33 be closer to the outmost two inner sidewalls of the inserting grooves 116 of the insulating housing 10 with keeping the bumps 331 always resisting against the outmost two inner sidewalls of the inserting grooves 116. When extract the plug connector out of the socket connector 100, the plug connector is gradually free from the buckling portions 34 of the latch 30, but the bumps 331 of the first clamping portions 33 still keep resisting against the outmost two inner sidewalls of the inserting grooves 116. So a steady insertion and extraction between the plug connector and the socket connector 100 can always be achieved.

As described above, in the process of inserting and extracting the plug connector with respect to the socket connector 100, the bumps 331 of the first clamping portions 33 of the latch 30 always keep resisting against the outmost two inner sidewalls of the inserting grooves 116 of the insulating housing 10. So that can make the action point between the latch 30 and the insulating housing 10 stable, and further ensure a steady insertion and extraction force between the plug connector and the socket connector 100. Moreover, the insertion and extraction force can be adjusted by changing the height or the position of the bumps 331.

What is claimed is:

1. A socket connector, comprising:

an insulating housing having a base portion and an inserting portion protruding forward from a front face of the base portion, a front face of the inserting portion being concaved and extending rearward to the base portion to form an inserting chamber, the back face of the base portion defining a receiving groove transversely extending, two sides of a front inner wall of the receiving groove being further concaved forward to form two inserting grooves of which each front end is located at the opposite side of the inserting chamber and communicated with the inserting chamber;

a plurality of conductive terminals disposed in the insulating housing, each of the conductive terminals having a contact portion at a front end thereof which projects into the inserting chamber; and a latch having a first base plate positioned vertically in the receiving groove of the insulating housing, two opposite side edges of the first base plate being bent and extending forward to form two first clamping portions slanted towards each other and inserted forward in the inserting grooves of the insulating housing, the free end of each first clamping portion being arched inward to form a buckling portion elastically projecting into the inserting chamber, two opposite outer sides of the first clamping portions protruding outward to form a pair of bumps located in the rear of the first clamping portions, the rears of the first clamping portions being close to outmost two inner sidewalls of the inserting grooves of the insulating housing with the bumps resisting against the outmost two inner sidewalls of the inserting grooves.

2. The socket connector as claimed in claim 1, wherein a top surface of the base portion is concaved downward to form a notch, a bottom wall of the notch defines a plurality of terminal grooves which extend along a front-to-rear direction and penetrate rearward through the base portion, the inserting chamber is communicated with a front end of each terminal groove, each of the conductive terminals has a fastening arm which is fastened in the terminal groove, the contact portion protrudes downward from a front end of the fastening arm, the socket connector further includes an insulating film disposed in the notch and covering the fastening arms of the conductive terminals.

3. The socket connector as claimed in claim 2, wherein a rear end of each terminal groove further extends downward to form a fastening groove, a rear end of the fastening arm of each conductive terminal protrudes downward to form a holding arm which is inserted and fastened in the fastening groove.

4. The socket connector as claimed in claim 1, wherein the front inner wall of the receiving groove of the insulating housing is further concaved forward to form a fastening slot arranged in the bottom of the front inner wall of the receiving groove, a substantial middle of a bottom edge of the first base plate of the latch is bent forward and extends to form a fastening portion which is inserted and fastened in the fastening slot.

5. The socket connector as claimed in claim 1, wherein a substantial middle of each side surface of the base portion protrudes outward to form a wing, the receiving groove of the base portion further extends forward to the side surfaces of the base portion and sideward to the back surfaces of the wings, each wing defines a first locking hole which penetrates longitudinally through the wing and is communicated with the receiving groove, the socket connector further includes a bracket which is accommodated in the receiving groove of the insulating housing and located behind the latch, the bracket has a second base plate covering the first base plate of the latch, two opposite side edges of the second base plate are bent forward and extend to form two second clamping portions disposed in the receiving grooves of the side surfaces of the base portion, front ends of the second clamping portions are oppositely bent outward and extend to form a pair of locking portions which are disposed in the receiving grooves of the wings, each locking portion defines a second locking hole which is aligned with the first locking hole of the wing.

6. The socket connector as claimed in claim 5, wherein the back face of the first base plate of the latch protrudes rearward to form a plurality of connecting bumps, the second base plate of the bracket and the first base plate of the latch are connected by spot welding on the connecting bumps.

7. The socket connector as claimed in claim 6, wherein the back face of the first base plate of the latch is covered with a film, the connecting bumps of the latch are exposed through the film and are surrounded by the film.

* * * * *